US008955204B2

(12) United States Patent
Scharnberg et al.

(10) Patent No.: US 8,955,204 B2
(45) Date of Patent: Feb. 17, 2015

(54) BUCKLE WITH HOUSING COMPRISING ELASTOMERIC DAMPING MASS

(75) Inventors: Ole Scharnberg, Hamburg (DE); Ronald Kliche, Schenefeld (DE)

(73) Assignee: Autoliv Development AB, Värgärda (SE)

( * ) Notice: Subject to any disclaimer, the term of this patent is extended or adjusted under 35 U.S.C. 154(b) by 583 days.

(21) Appl. No.: 12/602,588

(22) PCT Filed: May 20, 2008

(86) PCT No.: PCT/EP2008/004013

§ 371 (c)(1),
(2), (4) Date: Jun. 1, 2010

(87) PCT Pub. No.: WO2008/145274

PCT Pub. Date: Dec. 4, 2008

(65) Prior Publication Data

US 2010/0251523 A1 Oct. 7, 2010

(30) Foreign Application Priority Data

Jun. 1, 2007 (DE) ..... 10 2007 025 790

(51) Int. Cl.
*A44B 11/25* (2006.01)
*B60R 22/00* (2006.01)

(52) U.S. Cl.
CPC ..... *A44B 11/2546* (2013.01)
USPC ..... 24/642; 24/635; 24/637

(58) Field of Classification Search
CPC ..... B60R 21/04; F16F 1/37
USPC ..... 24/642, 635, 637
See application file for complete search history.

(56) References Cited

U.S. PATENT DOCUMENTS

| | | | | |
|---|---|---|---|---|
| 3,160,549 | A * | 12/1964 | Caldwell et al. | 428/317.3 |
| 3,275,131 | A * | 9/1966 | Erickson | 206/523 |
| 3,583,530 | A | 6/1971 | De Venne | |
| 4,597,141 | A | 7/1986 | Wier | |
| 4,903,377 | A * | 2/1990 | Doty | 24/194 |
| 4,940,254 | A * | 7/1990 | Ueno | 280/801.2 |
| 5,364,129 | A * | 11/1994 | Collins et al. | 280/806 |
| 5,432,987 | A * | 7/1995 | Schroth | 24/632 |
| 5,722,129 | A * | 3/1998 | Harrison et al. | 24/642 |
| 6,002,325 | A * | 12/1999 | Conaway | 340/384.1 |
| 6,473,947 | B2 * | 11/2002 | Yun | 24/579.11 |
| 6,725,509 | B1 * | 4/2004 | Lee et al. | 24/641 |
| 2002/0043872 | A1 * | 4/2002 | Townsend et al. | 297/473 |

(Continued)

FOREIGN PATENT DOCUMENTS

| | | |
|---|---|---|
| DE | 3128139 | 1/1983 |
| DE | 84 18 506 | 8/1985 |

(Continued)

*Primary Examiner* — Robert J Sandy
*Assistant Examiner* — Rowland Do
(74) *Attorney, Agent, or Firm* — Brinks Gilson & Lione

(57) ABSTRACT

A buckle for a safety harness in motor vehicles includes a buckle housing and a locking and unlocking mechanism housed therein, and a buckle tongue interacting with the locking and unlocking mechanism. The plastic buckle housing is provided with a silencing damping mass. The damping mass (12) is applied to the housing shells (10, 13) on the inside of the buckle housing to reduce the interior volume of the housing not occupied by the locking and unlocking mechanism.

4 Claims, 1 Drawing Sheet

(56) References Cited

U.S. PATENT DOCUMENTS

| | | | | |
|---|---|---|---|---|
| 2005/0135968 | A1 | 6/2005 | Augstein | |
| 2006/0244187 | A1* | 11/2006 | Downey | 267/140.3 |
| 2007/0129484 | A1* | 6/2007 | Horio et al. | 524/505 |
| 2008/0238074 | A1* | 10/2008 | Marriott et al. | 280/806 |
| 2008/0313871 | A1* | 12/2008 | Thorbole et al. | 24/633 |

FOREIGN PATENT DOCUMENTS

| | | | |
|---|---|---|---|
| DE | 102 59 115 | A1 | 1/2004 |
| DE | 10259115 | A1 | 7/2004 |
| EP | 1 212 956 | A2 | 12/2002 |
| FR | 2 509 616 | | 7/1982 |

* cited by examiner

BUCKLE WITH HOUSING COMPRISING ELASTOMERIC DAMPING MASS

CROSS REFERENCE TO RELATED APPLICATIONS

This application claims priority to PCT/EP2008/004013 filed May 20, 2008 and DE 10 2007 025 790.4, filed Jun. 1, 2007.

FIELD OF INVENTION

The present invention relates to a buckle for a seat belt harness for motor vehicles having a buckle casing and a locking and an unlocking device contained therein, and having a belt tongue interacting with the locking and unlocking device, wherein the buckle casing is made of plastic is provided with a damping mass for noise attenuation.

BACKGROUND OF INVENTION

The buckle having the above mentioned characteristics has been described in DE 102 59 115 A1. Insofar as the buckle that is installed in a motor vehicle causes rattling noise by hitting other installations of the motor vehicle, it is proposed to prevent and/or attenuate said rattling noise by applying a damping layer to the outside of the casing. Insofar as foam material is proposed as a damping material, the production of the casing cap forming the casing is addressed by means of insert-molding (in particular by means of two-component insert molding) in a single operation.

DESCRIPTION OF THE INVENTION

In its fundamental idea, the invention provides that the damping mass is applied to the case shells on the inside of the buckle casing to reduce the interior volume of the casing that is not occupied by the locking and unlocking device. The invention is associated with the advantage that the free interior volume of the buckle casing that is not occupied by the functional components of the locking and/or unlocking device are possibly filled with the damping mass, so that the functional noises are not prevented, but their propagation in the buckle casing is prevented. In this way, a reduction of the sound pressure level inside the buckle casing is advantageously accomplished, namely to a frequency range of approx. 1,600 Hz, relevant to a passenger's hearing. Not only is the sound pressure level reduced as a whole, but the sound audible outside of the casing is generated that is more pleasant to the person concerned, because it is at a lower frequency.

DETAILED DESCRIPTION OF THE INVENTION

Figure 2:
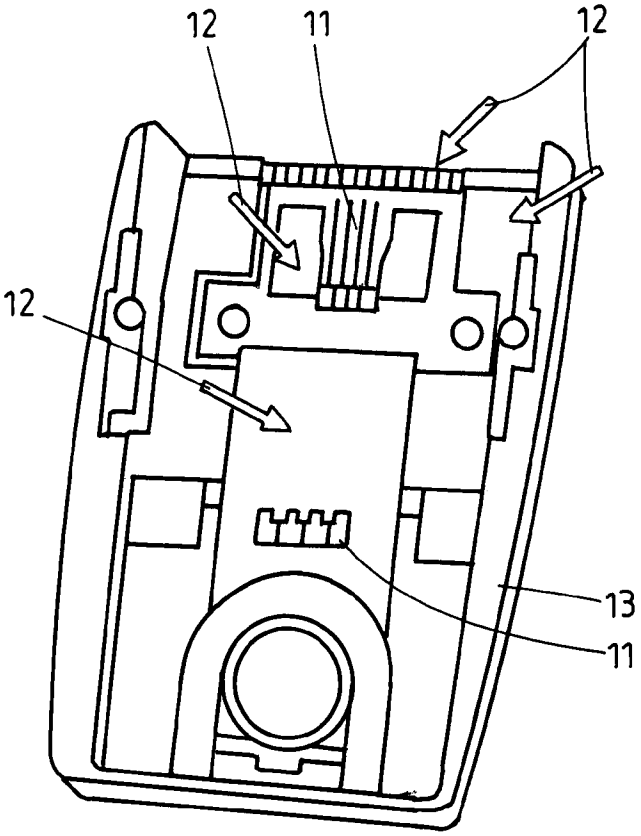
FIG. 2 illustrates the lower shell of the buckle in accordance with this invention.
Figure 1:
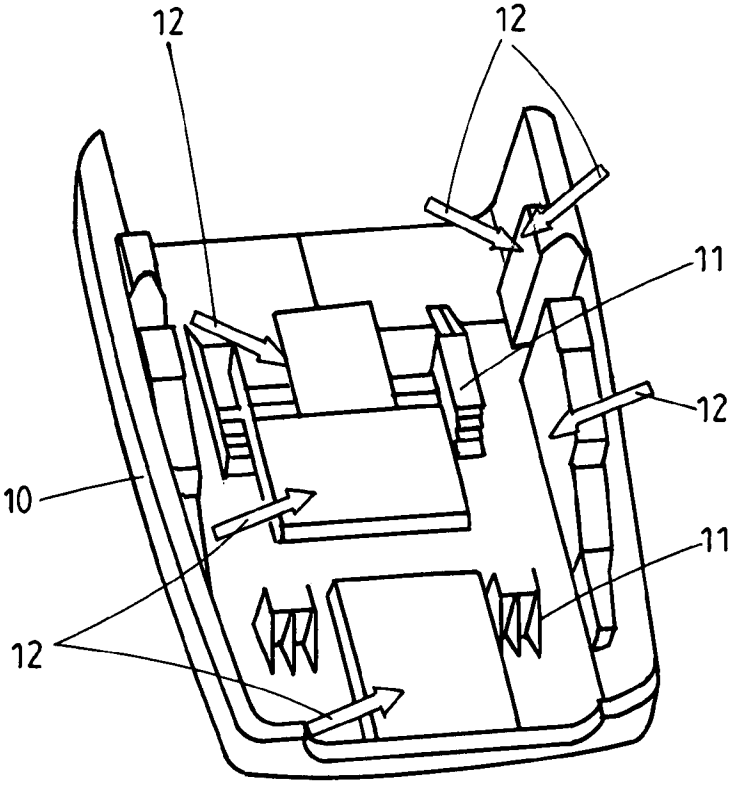
FIG. 1 illustrates the upper shell of the buckle in accordance with this invention.

Insofar as only the upper shell 10 and the lower shell 13 of a buckle casing are illustrated in the drawing, the additional illustration of the functional parts forming the locking and unlocking device located in the buckle casing has been dispensed with. The present invention does not specifically involve the functional parts which moreover are part of the different prior art designs of buckles known to a person skilled in the art. Gatings 11 are attached to both casing shells 10 and 13 shown in the drawing for fixing and/or connecting the corresponding functional parts. Damping masses designated with the reference numeral 12 are additionally applied to the upper shell 10 and lower shell 13 for the reduction of the free interior volume of a buckle casing formed by the upper shell 10 and lower shell 13. The casing shells 10 and 13 are in particular made of an ABS plastic, whereas the damping mass 12 is made of thermoplastic polyurethane. By using both these materials it is possible to produce the upper shell 10 and/or lower shell 13 together with the damping mass 12 to be applied thereto in a single operation by means of a two-component injection molding process.

The invention claimed is:

1. A buckle for a motor-vehicle seat belt harness having a belt tongue, the buckle comprising a buckle casing having greater dimensions in two directions than in a third, thereby defining a buckle plane spanned by the two greater dimensions, the buckle casing being formed by a pair of casing shells and a locking and unlocking device contained therein an interior volume, the locking and unlocking device configured to interact with the belt tongue, the buckle casing being made of plastic and provided with a damping mass for noise attenuation, the damping mass adhering to at least one inner surface of an outer wall of the casing shells on the inside of the buckle casing in the interior volume, extending along and in direct contact with the at least one inner surface, and occupying a portion of the interior volume that is not occupied by the locking and unlocking device, wherein the at least one inner surface of the casing shells extends parallel to the buckle plane.

2. The buckle according to claim 1, further comprising that the casing shells are made of ABS plastic and the damping mass is made of thermoplastic polyurethane.

3. The buckle according to claim 1, further comprising that the casing shells with the damping mass adhering thereto are produced in a single extrusion operation.

4. The buckle according to claim 1, wherein the damping mass is bonded to the at least one inner surface.

* * * * *